United States Patent [19]

Knowles

[11] 4,207,719

[45] Jun. 17, 1980

[54] COMPOSITE CONSTRUCTION BEAM

[76] Inventor: James Knowles, 1275 Club Dr., Bloomfield Hills, Mich. 48013

[21] Appl. No.: 893,317

[22] Filed: Apr. 3, 1978

[51] Int. Cl.[2] ..... E04C 3/292

[52] U.S. Cl. ..... 52/693; 52/98; 52/694

[58] Field of Search ..... 52/693, 694, 692, 691, 52/690, 642, 98, 99, 729

[56] References Cited

U.S. PATENT DOCUMENTS

| | | | |
|---|---|---|---|
| 2,201,047 | 5/1940 | Moore et al. | 52/729 X |
| 3,025,577 | 3/1962 | Jureit | 52/693 |
| 3,416,283 | 12/1968 | Sanford | 52/693 |
| 3,651,612 | 3/1972 | Schmitt | 52/693 |
| 3,748,809 | 7/1973 | Jackson | 52/693 X |
| 4,078,352 | 3/1978 | Knowles | 52/693 |

FOREIGN PATENT DOCUMENTS

| | | | |
|---|---|---|---|
| 252724 | 7/1967 | Austria | 52/693 |
| 977158 | 4/1965 | Fed. Rep. of Germany | 52/693 |
| 306573 | 7/1955 | Switzerland | 52/693 |

*Primary Examiner*—Alfred C. Perham
*Attorney, Agent, or Firm*—Cullen, Sloman, Cantor, Grauer, Scott & Rutherford

[57] ABSTRACT

A beam formed of an assembly of a pair of vertically spaced apart wood chord members interconnected by a number of angularly arranged, channel shaped struts located along the vertical faces of the chords and on opposite sides of the chords. The channel base of each strut is V-shaped in cross-section, with an apex angle that increases from top to bottom of the strut so that the base gradually flattens along the strut length in the upwards direction. The channel legs of each strut gradually increase in depth from bottom to top along the strut length, to thereby shift the location of the channel's neutral axis away from the base towards the free edges of the legs at the upper end of the strut. The upper and lower ends of the struts are extended to form enlarged, flat, connector plate portions having struck-out teeth for embedding into the adjacent vertical face portions of the chord members. The struts may be formed in integral groups of four arranged in two V-shapes integrally joined together at their adjacent connector plate portions. The upper chord may be wider than the lower chord so that while the connector plate portions are vertical, the struts are angled downwardly and inwardly relative to the lower chord to present an approximate wedge-like shape cross-section for the beam.

14 Claims, 19 Drawing Figures

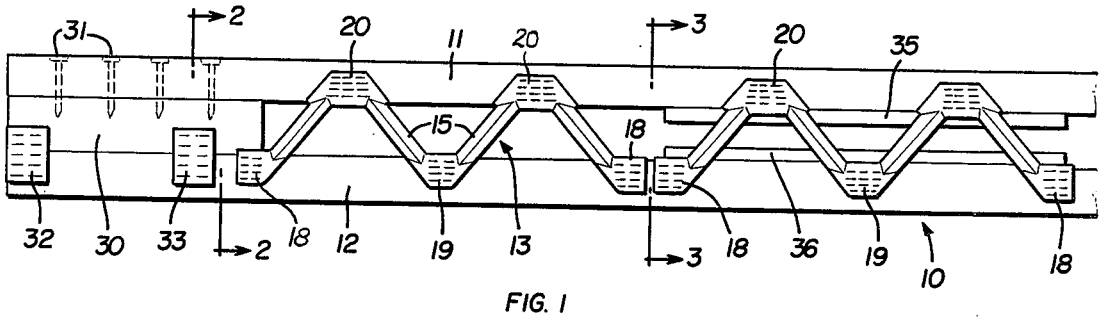
FIG. 1
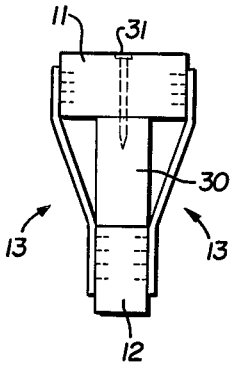
FIG. 2
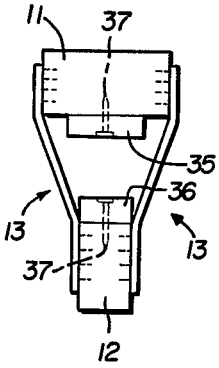
FIG. 3
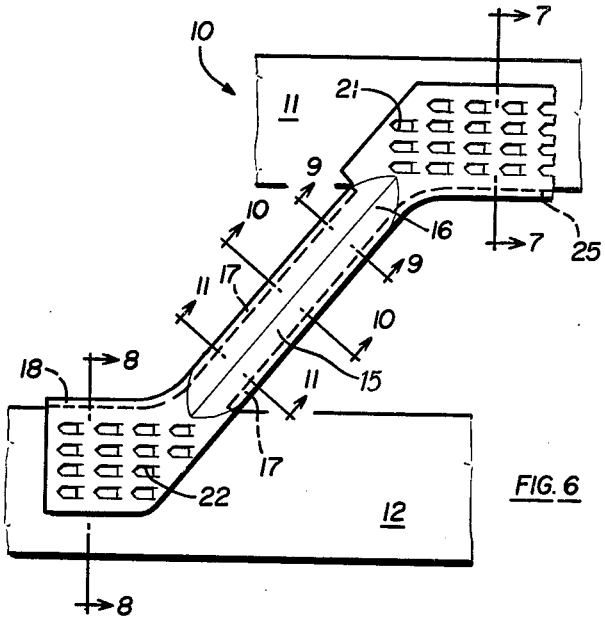
FIG. 6
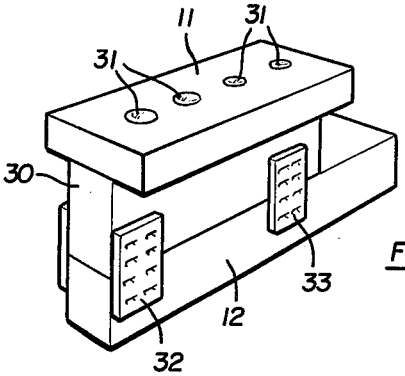
FIG. 4
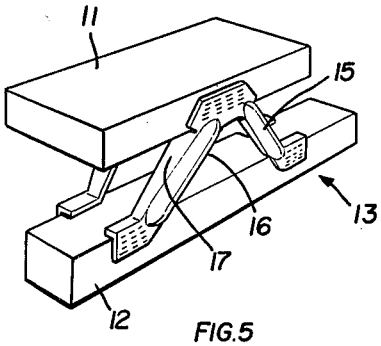
FIG. 5
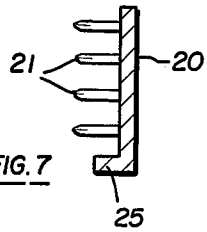
FIG. 7
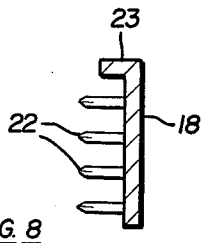
FIG. 8
FIG. 9
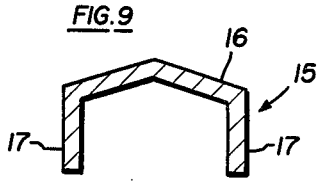
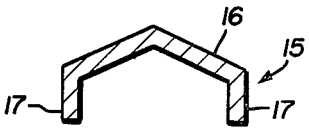
FIG. 10
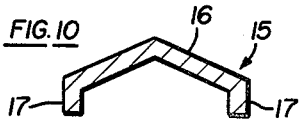
FIG. 11

COMPOSITE CONSTRUCTION BEAM

BACKGROUND OF INVENTION

The invention herein relates to a beam formed of an assembly of two wood chords interconnected by sheet metal struts in a truss-like construction, for use in place of a solid wood beam. In building constructions, particularly dwelling houses and small buildings, it is common to use large wood beams as joists or supports for floors and ceilings or flat roofs. Typically, these beams are made of solid wood whose nominal cross-sectional dimensions are on the order of 2×6 inches, or 4×6, or 4×8, 4×10 inches, etc. Essentially, the beam is rectangular in cross-section and is arranged with the height dimension being greater than the width dimension.

In recent years, the heavy demand for large wood beams, of the character described, has resulted in a shortage with accompanying increased prices. Hence, not only are available beam materials considerably more expensive than in the past, with the price continuing to escalate as the demand increases, but also the quality of available beams has been decreasing.

In the past, truss constructions, utilizing parallel chords and interconnecting webs or struts, have been used in building construction for roof support. An example of this sort of construction is illustrated in my earlier issued U.S. Pat. No. 4,002,116, granted Jan. 11, 1977 for an "Apparatus for Forming Trusses" and in my application Ser. No. 727,906 filed Sept. 30, 1976, now U.S. Pat. No. 4,078,352. However, a truss-type construction has not been utilized in the past in sizes and shapes useful as replacements for conventionally used beams. Prior trusses particularly have been too high, i.e., in vertical cross-sectional dimension, because of design strength requirements, to be utilized as a replacement for ordinary wood beams used as joists. Thus, the invention is concerned with a beam assembly construction which is sufficiently low cost to compete with solid wood beams and yet provide greater strength and dimensional stability, as well as other advantages.

SUMMARY OF THE INVENTION

The invention herein contemplates a beam assembly construction formed of an upper and a lower, vertically spaced apart, wood chord, interconnected on opposite vertical faces with metal struts angularly arranged relative to the lengthwise direction. The struts may be formed in integral groups which form multiple, interconnected V-shapes. These struts are formed in a channel-like shape in cross-section, with the channels opening towards each other, and with the upper and lower ends of the channels being integral with flat connector plate portions having struck-out spikes for embedding within the vertical faces of the wood chords. The channels are so formed as to shift the neutral axis inwardly of the upper chord in order to reduce considerably the forces which tend to push-out the upper connector plates and their spikes with respect to the upper chord.

By forming the legs of the channels in a gradually increasing depth, when measured from bottom towards the tops of the channels, and also forming the base of each channel in a V-shape which tends to flatten from the bottom towards the top of the channel, the neutral axis is shifted inwardly relative to the upper connector plate portion, thereby considerably reducing the lateral or sidewise or push-out force on the upper spikes.

The beam is preferably formed with the upper chord being wider than the lower chord so that the connector portions of the struts are arranged vertically, being in face to face contact with the vertical faces of the chords, but the channels are angled downwardly and inwardly relative to the smaller width, centrally located, lower chord. Thus, the overall assembly is of a roughly wedge-shaped cross-section, preferably, although it may be also formed of equal width upper and lower chords for certain purposes.

The overall assembly may utilize wood chords which are considerably shorter, in vertical dimension, than currently used wood beams, as for example 2×4's nominal size lumber, arranged horizontally for the upper chord and vertically for the lower chord, interconnected by sheet metal struts to form a composite eight inch high beam.

In order to simplify the dimensioning and use of the beams, the sheet metal struts are preferably spaced inwardly from the opposite ends of the beam and these opposite ends utilize wood fillers, which are of solid pieces of wood, to interconnect the upper and lower chords. Thus, the carpenter utilizing the beams may trim or cut off portions of the ends of the beams to dimension them for a particular site, without interference by the sheet metal struts.

In addition, the invention contemplates the reinforcement of these beams by locating relatively narrow, thin, wood strips as reinforcement plates along the center areas of the interior or facing surfaces of the two chords. That is, by way of example, a three foot length of wood which is narrower and much thinner than either chord may be fastened by nails and/or adhesive to the inner surface of either or both of the chords along the center of the beam to thereby considerably increase the beam strength where desired.

The overall object of this cnstruction is provide a composite beam construction which is usable in the same manner as an ordinary solid wood beam, as for example for joists and the like, including being trimmable or cuttable at its ends for dimensioning. However, the construction utilizes much less expensive and more available lumber, is economical, and provides greater strength than usual beams of wood.

These and other objects and advantages of this invention will become apparent upon reading the following description, of which the attached drawings form a part.

DESCRIPTION OF DRAWINGS

FIG. 1 is an elevational view of one end of a composite beam.

FIG. 2 is a cross-sectional view taken in the direction of arrows 2—2 of FIG. 1.

FIG. 3 is a cross-sectional view taken in the direction of arrows 3—3 of FIG. 1.

FIG. 4 is a perspective view of an end fragment of the beam.

FIG. 5 is a perspective view of an inner fragment of the beam.

FIG. 6 is an enlarged, elevational view of a fragment of the beam.

FIG. 7 is an enlarged cross-sectioonal view, taken in the direction of arrows 7—7 of FIG. 6, showing the upper connector portion of the strut.

FIG. 8 is an enlarged, cross-sectional view taken in the direction of arrows 8—8 of FIG. 6, showing the lower connector plate portion.

FIGS. 9, 10 and 11 are each enlarged cross-sectional views taken in the direction of arrows 9—9, 10—10 and 11—11, respectively of the strut channel.

DETAILED DESCRIPTION

Figure 12:
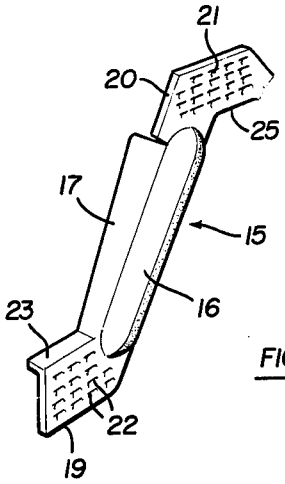
FIG. 12 is a perspective view of a fragment of the sheet metal strut, as it appears from the outside, i.e., channel base exposed surface.

FIG. 1 illustrates a portion of an elongated composite beam 10 which is of a size and length so as to be used in place of a single wood beam. For example, the composite beam may be 6 inches or 8 inches high and 20 feet in length. Of course, the length may vary considerably depending upon the place of use, but the height is contemplated to be generally in the area of common wood joist heights used in building construction, such as on the order of 6, 8, 10 or 12 inches, nominal dimensions.

The beam is formed of an upper wood chord 11 and a lower wood chord 12 which are vertically spaced apart and aligned along their central axis, as illustrated in FIGS. 2 and 3. By way of example, the wood chords could be conventional 2×4 lumber which actually is about 1½ inches by 3½ inches in size. The upper chord is laid on its side and the lower chord is vertically arranged so as to provide a roughly wedge-shape beam. By way of example, the two chords may be spaced apart 3 inches to give a total height of 8 inches.

The chords are interconnected by sheet metal struts, generally designated as 13. These struts, which may be made out of sheet steel of suitable thickness for rigidity and strength, are formed with a central channel or web 15. The channel is arranged at an angle relative to the longitudinal direction of the chords, as illustrated in FIGS. 1 and 6.

The channels are all identical, and each is provided with a V-shaped base 16 which, as illustrated in FIGS. 9, 10 and 11, have a decreasing apex angle, in the direction of the top of the channel towards the bottom. That is, the V-shape base at the upper end of the channel is flatter than that at the lower end with the angularity of the base continuously changing.

The channel legs 17, which are integral with the opposite edges of the base 16, gradually change from a small depth at the lower end of the channel towards a greater depth at the upper end of the channel. (See FIGS. 9, 10 and 11)

The channels are arranged in a V-like or zig zag configuration to form groups of V's, such as two V's integral to form one group. (See FIG. 1).

The bottom end of one channel, in each group, is provided with a flat, end connector plate portion 18, and the point of juncture between two channels which make up a vertically upright V are interconnected by an integral bottom or central connector plate portion 19. The connection between the inverted V-shaped apexes are each provided by an integral upper plate portion 20.

The upper connector plate portions 20 are each provided with struck out teeth or spikes of a length and suitable shape for embedding within the vertical opposite faces of the upper wood chord. Likewise, the lower connector plate portions 18 and 19 are each provided with struck out teeth or spikes 22 for embedding into the opposite vertical faces of the lower chord.

Figure 13:
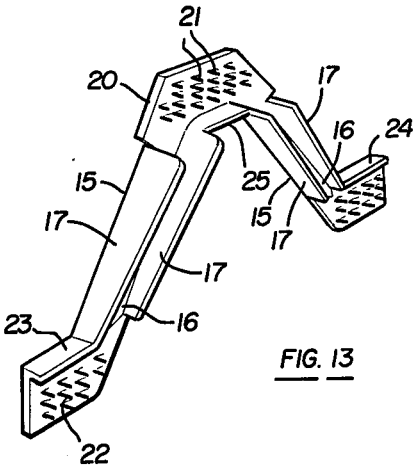
FIG. 13 is a view of the strut, in perspective, looking at the inside of the channel.

The end connector plate portion 18 is provided with a horizontally arranged, bent in, locating flange 23 (see FIG. 8). A similar bent flange 24 is formed on the upper edge of the central connector plate portion 19 (see FIG. 13). Also, the lower edges of each of the upper connector plate portions 20 are provided with inwardly bent locating flanges 25 (see FIGS. 7 and 13). These locating flanges fit upon the adjacent horizontal face portions of the chords for locating the struts and for rigidifying the struts.

As shown in FIGS. 1 and 4, the chords each extend horizontally a considerable distance beyond the struts, at both ends of the beam. The space between the chords at the opposite ends (only one end is shown in FIG. 1) is filled with a block of wood 30. The block is fastened to the inner faces of the chords by means of nails 31 as well as by a suitable adhesive (not shown). In addition, the block may be further fastened to the respective chords by means of conventional flat connector plates 32 and 33, each of which consists of a flat sheet of metal with inwardly struck teeth which are embedded within the wood block and adjacent chord area.

In use, the chords may be manufactured in standard lengths and shipped to a construction site as standard size beams. However, when positioned within the structure, the carpenters may shorten the beams by cutting off portions of their opposite ends, that is, cutting through the chords and block. Because the struts are considerably inwardly of the opposite ends, they do not interfere with the shortening of the beam, to the extent of the length of the respective blocks.

In shortening the beam, the carpenter would have to either cut around the fastening nails 31 and/or connector plates 33 or simply pull them out with a claw hammer.

In order to reinforce the beam, particularly to provide additional strength for heavier design loads where the beam is of considerable length, elongated wood strips are fastened to the inner facing surfaces of the chords in the central area of the beam. That is, an upper elongated wood strip or plate 35 and a lower elongated wood strip or plate 36 are fastened to the center portions of the chords by means of nails 37 and a suitable adhesive. By way of example, these strips or plates may be on the order of about 3 feet in length for a beam which is approximately 16 to 20 feet in length and are located at the central portion of the beam, thereby greatly reinforcing the beam and improving its load carrying capacity.

The strut channel is so formed that the neutral axis thereof is shifted inwardly relative to the upper connector plate. This reduces the force, due to beam loading, which tends to push out the upper teeth 21 and the connector plate from which such teeth are struck out.

Figure 14:
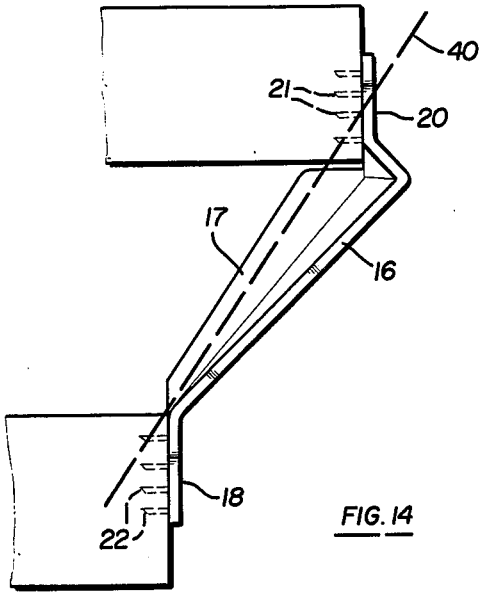
FIG. 14 is an enlarged, somewhat distorted, schematic end view of the chord and strut assembly.
Figure 15:
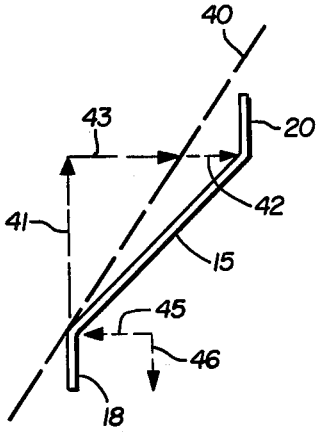
FIG. 15 is a schematic view illustrating a force diagram.
Figure 16:
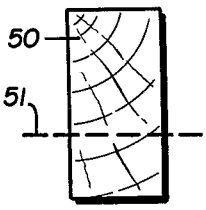
FIG. 16 is an end view of a single wood beam.

Referring to FIGS. 14 and 15, the loading on the upper chord can be resolved into two forces, one horizontal and one vertical. As shown in FIG. 15, the channel, due to the increasing depth of the legs from top to bottom, along with the decreasing height of the V-shape base from bottom to top, has its neutral axis 40 located inwardly, at an angle, as shown by the dotted line in FIG. 15. When the beam is loaded, the load can be plotted as a force or diagram having an upwards direction expressed by arrow 41 resisting the load, and a sidewise force 42 which tends to push the upper connector plate and teeth outwardly, sidewise, of the upper chord. The shifting of the neutral axis inwardly because of the channel configuration, reduces the sidewise force as illustrated by the arrow 43 so as to considerably reduce the amount of force tending to push out the upper teeth.

The lower teeth with the lower connectors are substantially uneffected, as indicated by the arrow 46, which represents the downward force, and the arrow 45 which represents an inward force. These forces tend to firmly and more completely embed the lower teeth. That is, the strut configuration, by reducing the push out force on the upper teeth, permits the beam to handle greater loads or to utilize thinner, less expensive material in its assembly. Meanwhile, the lower teeth tend to embed even more tightly due to the force absorption arrangement.

Figure 17:
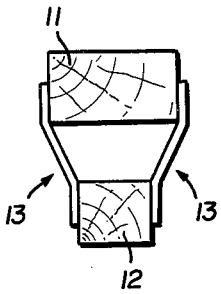
FIG. 17 is an end view of the beam after being cut into two sections and assembled with struts.

The wood chords may be made of separate strips of wood, such as conventional 2×4's or 1×3's etc. Alternatively, larger section beams may be cut lengthwise for that purpose. For example, utilizing a 2×5 or some other odd size, as shown in FIG. 6, the beam 50 may be cut longitudinally along line 51 to produce the wider upper chord 11 and the smaller lower chord 12 as shown in FIG. 17.

Figure 18:
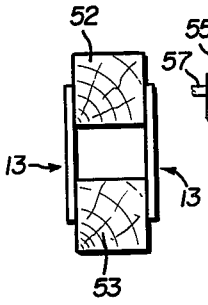
FIG. 18 is a modified beam having equal size upper and lower chords.

Alternatively, the upper and lower chords 52 and 53 may be of the same cross-sectional size, as illustrated in FIG. 18, in which case the struts do not bend inwardly into the wedge-like configuration. However, the loading of the struts, due to the configuration of the channels, still results in reduced push out forces on the upper connector plates while the lower connnector plates tend to embed their teeth more under load.

The sizes of the chords may be varied considerably, depending upon available lumber, and the cost of same, the uses of non-standard size pieces of wood, and the design requirements for handling loads. Thus, the specific cross-sectional shapes and sizes of the chords may be varied within the skill of the designer.

Figure 19:
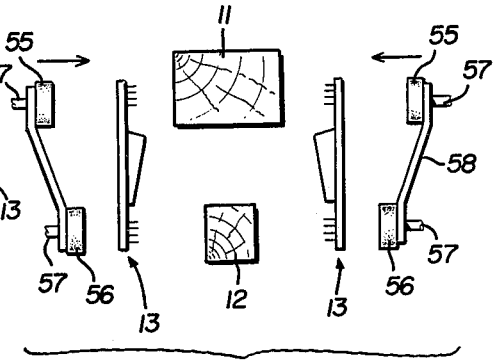
FIG. 19 is a schematic diagram showing the assembly of a composite beam.

FIG. 19 illustrates the manner of assembly of the chord. Here, the upper chord 11 and the lower chord 12 are secured in spaced apart relationship by suitable fixtures (not shown). Then, the flat or non-bent struts are arranged on the opposite sides. Thereafter, the struts are simultaneously pressed into the upper and lower chord vertical faces by means of upper plattens 55 and lower plattens 56 connected to powered rams 57. The upper and lower plattens are connected together by means of connection arms 58 which arrange the lower plattens inwardly of the upper plattens so that simultaneous movement of the plattens press the upper and lower connector plate teeth into the vertical faces of the chords, thereby bending the channel relative to these connector plates into the condition shown, for example, in FIG. 14.

Having fully described an operative embodiment of this invention, I now claim:

1. A strut for interconnecting a pair of horizontally elongated, vertically spaced apart wood chords having substantially vertical side faces, comprising:

an elongated sheet metal channel having its elongated base arranged upright and its legs formed to extend inwardly of the base, between the chords;

with said legs gradually increasing in depth, so that the channel gradually increases in depth along its length direction, from the bottom towards the top of the channel;

and each of the opposite ends of the channel base being extended into substantially flat, roughly vertically arranged, enlarged connector plates adapted for face to face engagement with aligned portions of the chord side faces, with said plates each having numerous struck-out teeth for embedding into their adjacent chord portions.

2. A strut as defined in claim 1, and said channel being V-shaped with its apex angle gradually increasing from bottom to top of the base along the length thereof, so that the base gradually becomes flatter along its length going from bottom to top.

3. A construction as defined in claim 2, and including said struts being formed in pairs connected together at one end by a common integral connector plate to form an integral V-shape.

4. A construction as defined in claim 2, and including at least two V-shapes joined end to end in a common plane by a common, integral connector plate to form a strut group.

5. A strut as defined in claim 2, and wherein said connector plates are arranged in substantially vertical planes, which are parallel, but spaced apart horizontally, wherein the lower plate is spaced longitudinally and transversely relative to the upper plate so that the channel is arranged angularly inwardly, relative to its open mouth, from top to bottom.

6. In a composite beam formed of a pair of horizontally elongated wood chords which are spaced vertically apart, one above the other, and with each having substantially vertical faces, with sheet metal struts on opposite sides of the chords and angled relative to the length direction of the chords, and with the opposite ends of each strut being extended into an enlarged, substantially flat, connector plate arranged in face to face engagement with adjacent portions of said chord vertical faces, and said plates having struck out teeth for embedding into adjacent chord portions, the improvement comprising:

said struts, between the chords, being formed of a squared U-shaped in cross-section channel, with the legs of the channels all being between the chords and extending substantially the entire distance along the lengths of their struts between the chords, and the channels on one side of the chords opening towards the channels on the opposite side of the chords;

and the legs of each channel gradually increasing in depth, so that each channel gradually increases in depth from bottom to top of the strut along the length thereof.

7. A construction as defined in claim 6, and wherein said channel bases are each V-shaped, with the apex angle of each V-shaped base gradually increasing from bottom to top of the base, so that the base gradually becomes flatter along its length when measured from bottom to top.

8. A construction as defined in claim 7, and said struts being formed in pairs connected together at one end by a common integral connector plate to form an integral V-shape, with at least two V-shapes joined end to end in a common plane by a common, integral connector plate to form a strut group.

9. A construction as defined in claim 7, and said upper chord being horizontally wider than said lower chord so that the struts, between their roughly vertical connector plates, are angled downwardly and inwardly wherein the beam is roughly wedge-shaped in cross-section.

10. In a composite beam as defined in claim 6 above, an elongated wood strip member secured to the inner horizontal face of at least one of the chords, at the middle portion of the beam, with said member being of substantial length and located between the struts arranged on the opposite vertical faces of the chords.

11. A construction as defined in claim 6 including an elongated, wood strip secured to the inner face of at least one chord near the middle of the beam to overlap the beam and areas closely adjacent to the middle, with the wood plate thus being located between adjacent struts and between the chords.

12. A construction as defined in claim 11, and including a second wood strip secured to the inner face of the opposite chord, and of a length to overlap the middle portion of the chord and being roughly aligned with the first mentioned strip for thereby reinforcing the center portion of the beam.

13. A construction as defined in claim 6 including an elongated wood block arranged at one end of the beam, between the two chords and in face to face contact with the chords to fill the space therebetween for a substantial portion of the end of the beam and mechanically secured to the chords;

with the strut nearest to the end of the beam being spaced inwardly of the beam end a sufficient distance approximately equivalent to the length of the wood block;

whereby the length of the beam may be adjusted by cutting off predetermined portions of the end of the beam, i.e., the chord-block portion.

14. A beam as defined in claim 13, and including wood blocks, identical to that set forth above, located at each of the opposite ends of the beam for thereby permitting adjustment of the length of the beam by cutting off portions of either or both ends of the beams.

* * * * *